US006131220A

United States Patent [19]

Morimura

[11] Patent Number: 6,131,220

[45] Date of Patent: Oct. 17, 2000

[54] MAT FOR NURSING BED

[75] Inventor: Tadaki Morimura, Oosaka, Japan

[73] Assignee: Morimura Kousan Kabushiki Kaisha, Minoo, Japan

[21] Appl. No.: 09/062,830

[22] Filed: Apr. 20, 1998

[51] Int. Cl.[7] ..... A47C 16/00

[52] U.S. Cl. ..... 5/652.1; 5/704; 5/722; 5/606

[58] Field of Search ..... 5/652.1, 724, 730, 5/704, 633, 656, 606, 928, 638, 722; 108/24

[56] References Cited

U.S. PATENT DOCUMENTS

| | | | |
|---|---|---|---|
| 169,442 | 11/1875 | Horton | 5/724 |
| 1,423,954 | 7/1922 | Maussner | 5/722 |
| 2,165,385 | 7/1939 | Kane | 5/606 X |
| 3,042,938 | 7/1962 | Lawson | 5/638 |
| 3,889,302 | 6/1975 | Ketterer et al. | 5/606 X |
| 5,388,296 | 2/1995 | Mansour | 5/638 X |

FOREIGN PATENT DOCUMENTS

| | | |
|---|---|---|
| 1451829 | 10/1976 | United Kingdom . |
| 2274054 | 7/1994 | United Kingdom . |
| 2309896 | 8/1997 | United Kingdom . |

*Primary Examiner*—Terry Lee Melius
*Assistant Examiner*—Fredrick Conley
*Attorney, Agent, or Firm*—Armstrong, Westerman, Hattori, McLeland & Naughton

[57] ABSTRACT

A mat for a nursing bed having a number of repeatedly flexing thermoplastics filaments aggregated to form a stereonetwork aggregation having through hole portions for cleaning pipes, ventilating pipes, deodorants, and the like, with notches formed therein for flexibly forming the mat in a reclining motion of the bed to accommodate the body of a person on the mat.

5 Claims, 4 Drawing Sheets

MAT FOR NURSING BED

BACKGROUND OF THE INVENTION

1. Field of the Invention

This invention relates to a mat as a core for nursing beds used in hospitals, etc., and a method for producing such 2. Prior Art Conventional mats for nursing beds are made of urethane, straw, synthetic fiber-cotton, springs and the like.

A mat of nursing beds are sometimes soiled unwillingly by patients' sewage or vomit. It is impossible to change the thus soiled mats each time such mats are soiled, while conventional mats are being washed in boiling water or sterilized by steam for soil treatment.

There has been required, to improve a mat for a nursing bed mats easily washed in boiling water or sterilized by steam for keeping a clean condition and which are capable of being desirably followed in a reclining motion of the bed body, and a method for producing such mats without difficulty.

SUMMARY OF THE INVENTION

Accordingly, it is an object of the present invention to provide a mat for a nursing bed in which a number of repeatedly flexing thermoplastics filaments are aggregated to form a stereonetwork aggregate provided with through hole portions for keeping cleaning pipes, ventilating pipes, deodorants, etc., with notches formed therein so that the mat is flexed along with a reclining motion of the bed when applied thereto.

A further object of the present invention is to provide a method for producing a mat for a nursing bed which comprises forming and suspending a number of filaments by continuously extruding a thermoplastic resin in molten fluid state from each orifice set on a die, repeatedly flexing the thus suspended filaments by taking them at lower speed than a fall-down speed thereof in still molten and not yet cured state and aggregating a stereonetwork by gluing the filaments to each other at points of contact, cooling and curing the thus formed stereonetwork aggregate, and conducting processes of notching and mat-shape cutting, at the same time, or one after another. the die being provided with a plurality of downward opening orifices at nearly equal spaces on a definite plane so as to leave void portions at predetermined positions.

PREFERRED EMBODIMENTS AND DETAILED DESCRIPTION OF THE INVENTION

Preferably, thermoplastics used in the present invention have a heat-resistant temperature of 100° C. or above, such that filaments formed therefrom can be subjected to a sterilizing treatment.

It is desirable to use plastics having a heat-resistant temperature of 100° C. to 120° C. as a material of stereonetworking filaments to produce the mat of the present invention.

Diameters and density o the filaments may be appropriately varied, depending on a specific site to be applied in the mat, so that the best condition for general use including both pertinent pliability and pressure resistance required are imparted to the mat. For example, there may be increased density of the filaments used for forming the surface, or a portion close thereto, and decreased density in an inner portion of the mat, while diameters of the filaments may be thicker in the vicinity of the surface and thinner in the inner portion.

Such changes in density and diameters of the filaments can be easily conducted by controlling an arrangement and diameter of orifices on a die. The density may also be changed by locally controlling extrusion speed of a plastic material.

The mat for a nursing bed of the present invention has fundamental functions required in a conventional mat. According to the present invention, pipes for a purpose of cleaning, washing, etc. are inserted into through hole portions formed in the mat for injecting hot water or steam therethrough so as to wash or sterilize the mat, thereby keeping the mat in a clean condition by easy treatment even when the mat is soiled by patients' sewage or vomit. Further, the mat of the present invention can be dried immediately after water washing because of stereonetwork structure thereof, which shortens a cleaning work. On the other hand, as fresh air is injected into the mat through the through hole portions or, on the other hand, stagnant air is evacuated therethrough, the patients are kept in a preferable environment. A sterilizing treatment of the mat is further useful from a viewpoint of keeping a clean condition or sanitization, which greatly contributes to prevent hospital infection. Furthermore, the mat is easily flexed and thus formed smoothly to a reclining motion of a bed body because of such notches.

The sterilizing treatment may be conducted either by advanced mixing a sterilizing agent in a starting resin material or by coating a sterilizing agent on the surface of filaments after the stereonetwork aggregate is formed.

A method of the present invention easily produces the present mat which is well suitable for sanitization.

EXAMPLE

Figure 1:
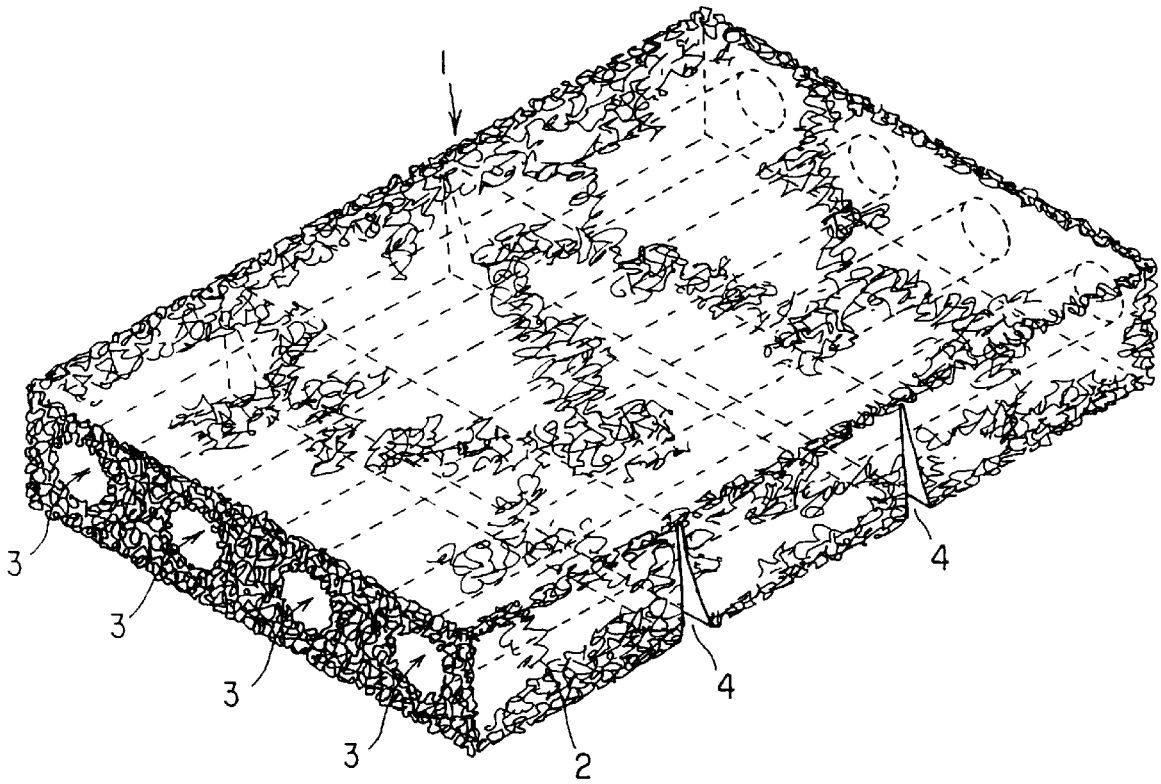
FIG. 1 is a perspective view of a mat.

Referring now to the drawings, preferred embodiments of the present invention will be described in the following.

Figure 2:
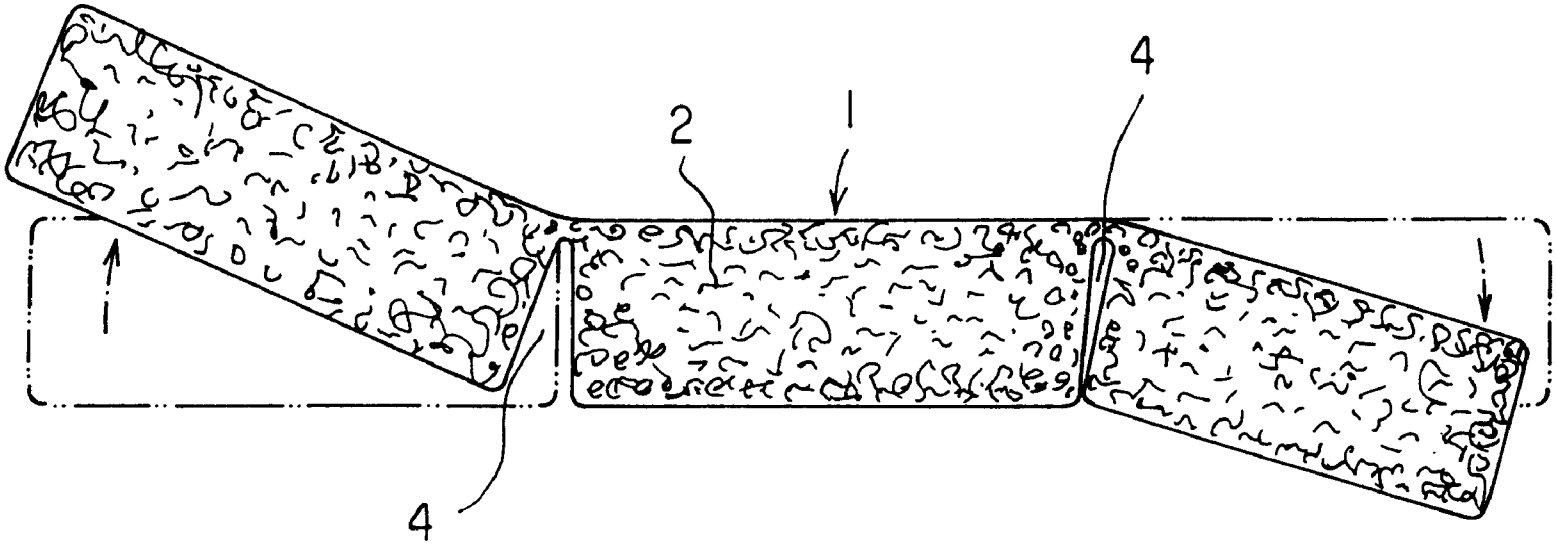
FIG. 2 is a side view of a mat in a flexed situation suitable for following to a reclining motion of a bed body.

FIGS. 1 and 2 show a mat 1 of the present invention. The mat 1 is shaped in a square board of certain thickness prepared by repeatedly flexing a number of polypropylene filaments 2 to aggregate a stereonetwork. Through hole portions 3 having a diameter of about ⅓ of the board thickness are formed inside of the mat 1 in the length or longitudinal direction. The through hole portions 3 are used to insert cleaning or ventilating pipes or to supply cases or bags of deodorants, etc. and are not restricted to have a specific sectional shape or a limited diameter if such items achieve the objects of the present invention.

As shown in FIG. 2, two lateral notches 4 are formed at trisected positions in the length direction of the mat 1 so as smoothly follow to a reclining motion of a bed body to which the mat is applied. Two or more notches 4 are preferably formed on each mat.

Although a sterilizing treatment has been applied by mixing a sterilizing agent in the filaments 2 themselves in this embodiment, any other sterilizing means may be used.

Figure 3:
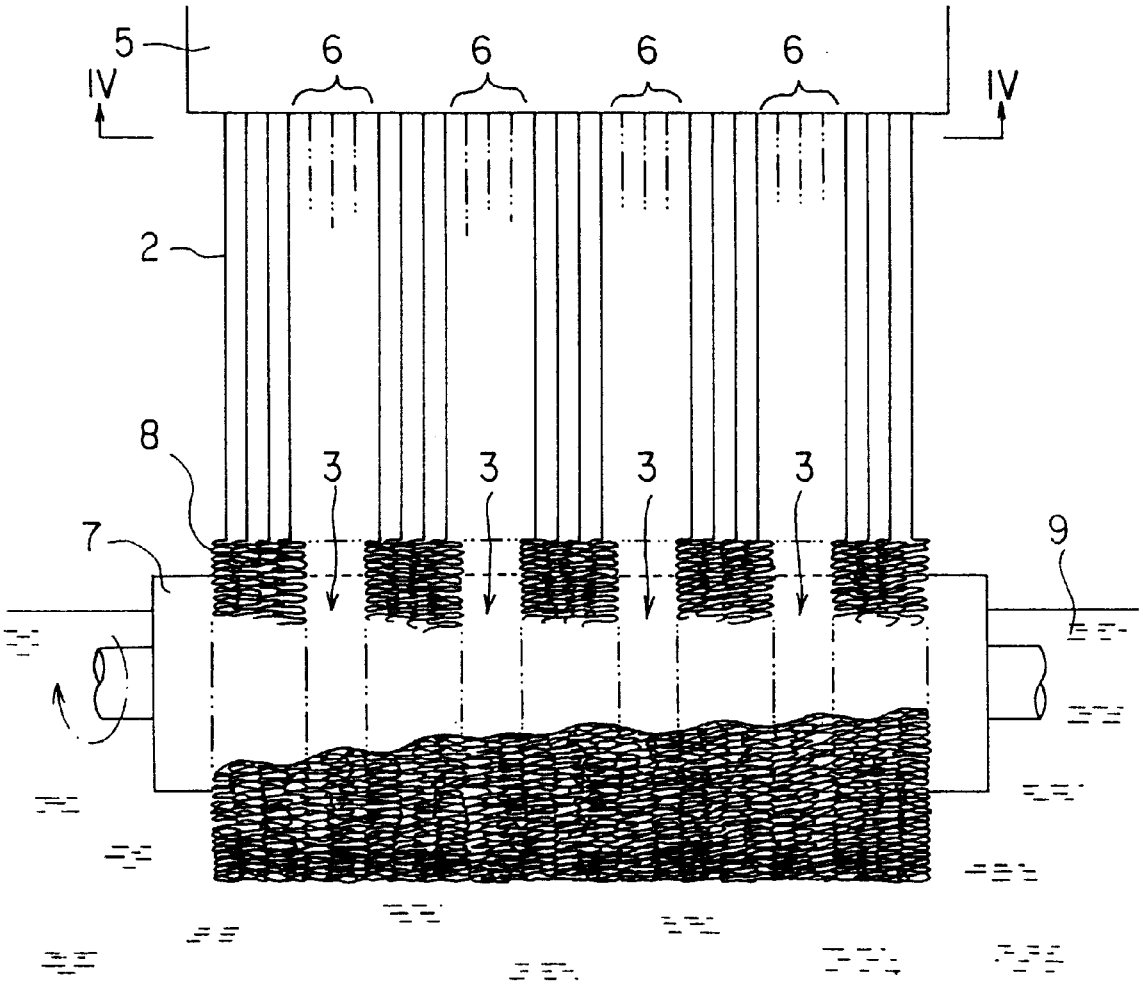
FIG. 3 is a schematic view of a producing process.

FIG. 3 is a schematic view of a method for producing the above mentioned mat. The present method for producing a mat will be described referring to FIG. 3 in the following.

Figure 4:
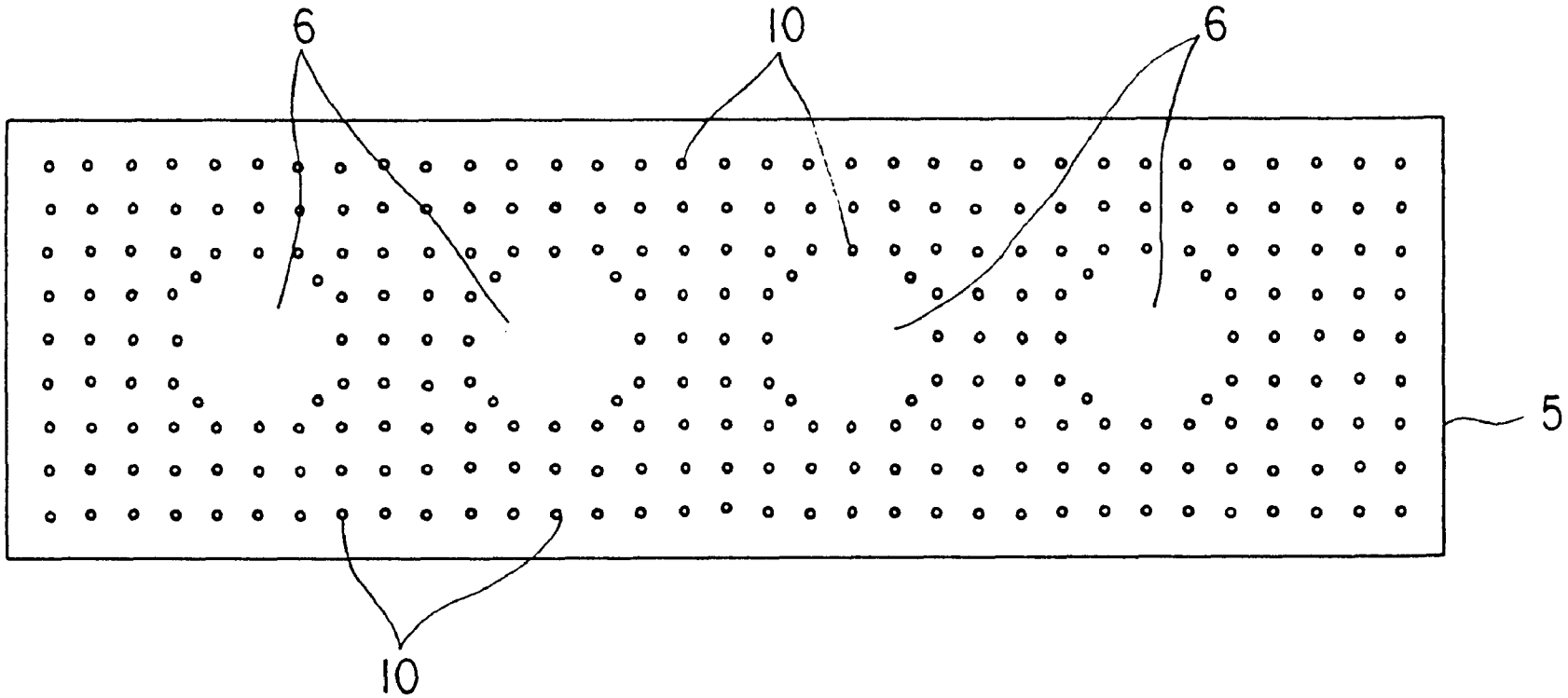
FIG. 4 is a plan view taken on line IV—IV in FIG. 3 showing an arrangement of orifices set on a die surface.

Numeral 5 designates an extruder die in FIG. 3. The die 5 is provided with a plurality of downward opening orifices 10 (FIG. 4). Downward opening orifices 10 are arranged on a plane at nearly equal spaces while leaving sectionally circular void portions 6 where no orifice is arranged. The through hole portions 3 are formed by means of the void portions 6, i.e., through hole portions 6 are circular when a section of the void portions 6 is circular as shown in FIG. 4, while square holes are formed if the void portions are square.

A thermoplastic resin, such as polypropylene, is heated to a molten condition in an extruder, and is then continuously extruded through the orifices 6 of the die 5 to continuously form a number of downward suspending filaments 2. A sterilizing treatment of the filaments 2 is conducted by mixing a sterilizing agent in the resin before extrusion thereof. Such a sterilizing treatment may be done after a mat forming process by coating a sterilizing agent on the mat as a matter of course.

The thus suspended filaments 2 are then taken, at downward positions thereof, by a surface of take-off roll 7 which is arranged at a downward position of the die 5 at intervals enough to keep the filaments 2 still molten, or not yet in a cured state and rotates at lower surface speed than fall-down speed of the filaments 2. Each of the filaments 2 is zigzagged and repeatedly flexed on the surface of the take-off roll 7 in the above mentioned manner and glued to each other at points of contact, under a still molten condition, to form a stereonetwork aggregate 8. While the filaments 2 are not formed under the void portions 6 where no orifice is arranged on the die, the through hole portions 3 are formed thereunder in order, without aggregation of stereonetwork of the filaments 2. As the take-off roll 7 is immersed in cooling water except an upper part thereof, the stereonetwork aggregate 8, aggregated on the surface of the take-off roll 7, is successively immersed, cooled and cured in water to constantly form the stereonetwork aggregate 8 as a mat. The stereonetwork aggregate 8 is completely cured, taken out of water and then dried.

The thus formed stereonetwork aggregate 8 is a long board body, which is then cut to length suitable for fitting on a bed body to be applied, and at the same time, forming notches 4 at appropriate positions thereof so as to flex in response to a reclining motion of the bed body. The notches 4 are formed by cutting the mat in the thickness direction thereof and leaving a partially uncut portion in thickness, thereby yielding a complete mat product of the present invention. Each process of notching and mat-shape cutting may either be conducted simultaneously or one after another.

DESCRIPTION OF THE PREFERRED EMBODIMENTS

FIG. 1 is an exploded perspective view of a lock nut device showing an embodiment of the present invention, and FIG. 2 is a sectional view of a lock nut device of FIG. 1, in assembled state. A threaded shaft 1 is constituted by a threaded part, such as, a threaded shaft or a bolt, to be used for various sorts of machines, materials, tools, and the like. A nut setting ring 2 is loosely fitted to an outer circumference of the threaded shaft 1, and can be easily moved and held still at any position.

Split nuts 3 have a taper thread part divided into two parts in the axial direction of the nuts, and at an inner surface 3*a* of the split nuts 3, an inner thread 31 for engagement with an outer thread of the threaded shaft 1. At the inner surface of both split nuts 3, a locking groove 32 is provided into which the nut setting ring 2 can be inserted. Width of the locking groove 32 formed in split nuts 3 are nearly the same as that of nut setting ring 2. When the nut setting ring 2 is inserted in the locking groove 32, the nut setting ring 2 can be easily fitted on threaded shaft 1. The depth of the locking groove 32 is larger than the thickness of the nut setting ring 2.

Also, a hexagonal head 34 is provided at one end of split nuts 3. Shape of the head 34 is the same as that of the head of lock nut 4 described later. An outer circumference of a cylindrical part succeeding the head 34 is in taper shape with diameter decreasing toward the end, and an outer thread 33 is formed on an outer circumferential surface 3*b* of the cylindrical part. Both split nuts 3, 3 divided in two, are formed so that when the inner thread 31 is threadedly engaged with and fitted to the outer circumference of threaded shaft 1, a gap 6 is formed between split nuts 3, 3.

As inner surface 4*a* of the lock nut 4 is tapered corresponding to the outer circumferential surface 3*b* of the cylindrical part of the split nuts 3, and the inner surface 4*a* has provided an inner thread 41 threadedly engaged with the outer thread 33.

In order to fix a nut to threaded shaft 1, using a lock nut device in the above-mentioned configuration, first, the nut setting ring 2 is placed around the outer circumferential part of the threaded shaft 1 and stands still in a prescribed position.

Next, split nuts 3, divided in two, are fitted so as to envelope the outer circumference of threaded shaft 1 and the nut setting ring 2. The nut setting ring 2 is fitted into a locking groove 32. FIG. 1, provided at the inner circumference of the split nuts 3, and the inner screw 31 of the split nuts 3 is fitted to the thread of threaded screw shaft 1. Thus, the split nuts 3, divided in two, are held in the assembled state in one body at a desired position of the outer circumferential part of threaded shaft 1 by the fitting of the locking groove 32 at the inside and the nut setting ring 2.

Next, a lock nut 4 is put around the threaded shaft 1 and also threadedly engaged with the outer thread 3*b* on the outer circumferential part of the split nuts 3, and both split nuts 3 are tightened by turning the lock nut 4. Then a gap 6 exists at a joining portion between the two split nuts 3, and further because the outer screw 3*b* on the outer circumference of the split nuts 3 is formed in a taper surface and the inner screw 4*a* of the lock nut 4 corresponding to the shape of the outer screw 3*b*, the split nuts 3 are tightened and fixed strongly on the screw shaft 1 by turning the lock nut 4.

In order to release the lock of the lock nut device, the lock nut 4 is turned in the loosening direction and the tightening of the split nuts 3 is released. If the lock nut 4 is detached from the outer circumference of the split nuts 3, the split nuts 3 can be easily detached from the outer circumferential part of the screw shaft 1. Thus, since the nut setting ring 2, fitted loosely to the outer circumference of the screw shaft 1 becomes free, it can be moved along the screw shaft 1 to any position or detached from the screw shaft 1.

The lock nut device can be constituted by very small number of parts, the nut setting ring 2, the two split nuts 3 and the lock nut 4, and can lock a nut rapidly, and simply, to any position of a screw shaft 1, such as a bolt. Even if the split nuts are fastened with rust, the split nuts can be easily detached by detaching the lock nut, and the lock nut device can be conveniently used for various sorts of machines, transporting devices and the like.

The C-type ring 5 with a part thereof cut away, as shown in FIG. 4, is used as a nut setting ring, and also a divided-type ring, can be used.

What is claimed is:

1. A mat for a nursing bed in which a number of repeatedly flexing thermoplastic filaments are aggregated and form a three dimensional stereonetwork aggregate mat of adhering filaments, said three dimensional stereonetwork mat having through hole portions, each through hole portion extending longitudinally completely through said mat for at least one of cleaning pipes, ventilating pipes and pipes for deodorants and disinfectants, and notches formed in said mat transverse said mat for flexibly following a reclining motion of a bed to which said mat is applied.

2. A mat for a nursing bed as claimed in claim 1 wherein said thermoplastic has a heat resistant temperature of 100° C. or above.

3. A mat for a nursing bed as claimed in claim 1 wherein the filaments are subjected to a sterilization treatment.

4. A mat for a nursing bed as claimed in claim 1 wherein the density of the filaments is higher in a surface portion of the mat and lower in an inner portion of the mat.

5. A mat for a nursing bed as claimed in claim 1 wherein the diameters of the filaments are thicker in a surface portion of the mat and thinner in an inner portion of the mat.

* * * * *